US008707732B2

(12) United States Patent
Achmedschanow

(10) Patent No.: US 8,707,732 B2
(45) Date of Patent: Apr. 29, 2014

(54) ARRANGEMENT FOR THE PRESENTATION OF A JEWELLERY ELEMENT

(76) Inventor: Anwer Achmedschanow, Worms/Rhein (DE)

( * ) Notice: Subject to any disclaimer, the term of this patent is extended or adjusted under 35 U.S.C. 154(b) by 761 days.

(21) Appl. No.: 12/223,098

(22) PCT Filed: Jan. 18, 2007

(86) PCT No.: PCT/DE2007/000106

§ 371 (c)(1),
(2), (4) Date: Oct. 28, 2008

(87) PCT Pub. No.: WO2007/082518

PCT Pub. Date: Jul. 26, 2007

(65) Prior Publication Data

US 2009/0241600 A1 Oct. 1, 2009

(30) Foreign Application Priority Data

Jan. 19, 2006 (DE) ..... 10 2006 002 671

(51) Int. Cl.
*A44C 17/02* (2006.01)

(52) U.S. Cl.
USPC ..... 63/31; 63/15; 63/26

(58) Field of Classification Search
USPC ..... 63/15, 29.1, 30, 31, 40, 3, 29.2, 33, 23, 63/26; D11/91
See application file for complete search history.

(56) References Cited

U.S. PATENT DOCUMENTS

| | | | | |
|---|---|---|---|---|
| 922,212 | A * | 5/1909 | Tropin | 63/31 |
| 1,553,198 | A * | 9/1925 | Stern | 63/31 |
| 1,971,265 | A | 8/1934 | King | |
| 3,693,376 | A | 9/1972 | Willner | |
| 4,052,864 | A | 10/1977 | Hofsaess | |
| 4,726,200 | A * | 2/1988 | Carter | 63/15 |
| 4,970,878 | A * | 11/1990 | Lee | 63/23 |
| 5,433,090 | A * | 7/1995 | Santiago | 63/29.1 |
| 6,612,132 | B2 * | 9/2003 | Kimura et al. | 63/31 |
| 6,820,442 | B2 * | 11/2004 | Kimura | 63/31 |
| 6,851,279 | B2 * | 2/2005 | Hartgrove | 63/31 |
| 6,857,289 | B1 * | 2/2005 | Cheng | 63/31 |
| 2003/0110797 | A1 | 6/2003 | Kimura et al. | |
| 2003/0172673 | A1 | 9/2003 | Kimura | |

FOREIGN PATENT DOCUMENTS

| | | |
|---|---|---|
| DE | 21 20 856 | 11/1971 |
| DE | 22 04 504 | 8/1972 |
| DE | 31 04 396 | 8/1982 |

(Continued)

*Primary Examiner* — Victor Batson
*Assistant Examiner* — Abigail Morrell
(74) *Attorney, Agent, or Firm* — Frommer Lawrence & Haug LLP

(57) ABSTRACT

An arrangement for the presentation of a jewelry element which has a carrier, the carrier and the jewelry element each having a pair of bearing parts for supporting the jewelry element. The bearing parts associated with the carrier are a component part of a separate bearing device. The carrier, the jewelry element, and the bearing device are modular structural component parts. The bearing device can be connected to the carrier and to the jewelry element. The bearing parts may comprise a pin and a recess for movably supporting the jewelry element. The pin converges in the direction of the recess according to a defined converging angle. The recess diverges in direction of the pin according to a diverging angle. The diverging angle is greater than the converging angle. The pin and the recess meet at the vertex of the diverging angle and converging angle to form a point-type bearing support.

21 Claims, 3 Drawing Sheets

(56) References Cited

FOREIGN PATENT DOCUMENTS

| | | |
|---|---|---|
| DE | 296 19 854 | 2/1997 |
| DE | 202 02 367 | 5/2002 |
| FR | 2 420 314 | 10/1979 |
| FR | 2 814 043 | 3/2002 |
| JP | 2002-142817 | 5/2002 |
| WO | 96/33633 | 10/1996 |

* cited by examiner (Detail)

ARRANGEMENT FOR THE PRESENTATION OF A JEWELLERY ELEMENT

The present application claims priority from PCT Patent Application No. PCT/DE2007/000106 filed on Jan. 18, 2007, which claims priority from German Patent Application No. DE 10 2006 002 671.3 filed on Jan. 19, 2006, the disclosure of which is incorporated herein by reference in its entirety.

BACKGROUND OF THE INVENTION

1. Field of the Invention

The present invention is directed to an arrangement for the presentation of a jewelry element with a carrier, the carrier and the jewelry element each having a pair of bearing parts for supporting the jewelry element. Further, the invention is directed to a bearing device for forming an arrangement for the presentation of a jewelry element, the bearing device and the jewelry element each having a pair of bearing parts for supporting the jewelry element, and to a method for assembling an arrangement, particularly using the bearing device.

2. Description of Related Art

The bearing support of jewelry elements is a perpetual concern of jewelers. A precious stone should be presented in the most effective manner possible, and even stones of lesser quality should be presented well.

US 2003/0172673A1 is directed to a piece of jewelry comprising a supporting structure for movably supporting a jewelry element. The supporting structure has two separate bearing parts at a distance from one another. Each bearing part is a component part of a carrier and is, for example, screwed or otherwise fitted to the latter. The two individual bearing parts, their alignment and their connection to the carrier must already be considered complicated in themselves in view of the separate work steps. The bearing parts of the jewelry element are associated with its setting.

It is known from the above-cited reference to provide the bearing parts in the form of pins or recesses. While the jewelry element is indeed supported in a movable manner, a swinging, shaking or pivoting movement takes place around the two pin axes. This swinging, shaking or pivoting movement around the two pin axes occurs because the pins have play in the recesses. When a change in the position of the movably supported jewelry element occurs due to the movement of the piece of jewelry by the carrier and/or by gravitational force, the pin moves aimlessly, zigzagging back and forth in the recess.

A jewelry element with a stone and setting with bearing parts in the form of pins is also disclosed in JP 2002 142817A. Each pin engages in a concave recess of a screw which is screwed into the opening of a bearing part. The two bearing parts which are connected to the carrier are constructed in two parts, which increases production costs and assembly costs. The alignment of the bearing parts alone demands a high degree of precision. The concave curvature could lead to inaccurate support and increased friction. Further, the arrangement disclosed in this reference may not be practical because the setting must be made of a soft material owing to the properties of the precious stone, whereas the pins must have a greater hardness, but both are made from the same material.

SUMMARY OF THE INVENTION

Proceeding from the known prior art, it is the object of the invention to provide an arrangement of the type mentioned above which is economical and which makes possible an optimized, low-friction bearing support of the jewelry element. Further, a bearing device and a method are to be provided for reducing production costs.

The above-stated object is met in a first alternative embodiment, wherein an arrangement of the type mentioned above is constructed in such a way that the bearing parts associated with the carrier make up components of a separate bearing device, in that the carrier, the jewelry element and the bearing device are modular structural component parts, and in that the bearing device can be connected to the carrier and to the jewelry element.

Based on the prior art, it was realized according to a first alternative that the bearing parts for the jewelry element comprise two separate bearing parts which are to be allocated to the carrier or constructed integral therewith and which must have a precise alignment. The resources required for this are reduced according to the invention in that the bearing device effectively integrates the two bearing parts in one piece and the carrier, the jewelry element, and the bearing device are modular structural component parts which can be connected to one another. Accordingly, the user in the jewelry industry is provided with intermediate products which are assembled to form a whole without having to carry out alignments or adjustments individually. The advantages of the modular construction principle result from the fact that standardized modules reduce costs and shorten production times by reducing manual labor.

The above-stated object is met according to a second alternative embodiment. According to this second alternative, an arrangement of the type mentioned above is constructed in such a way that the bearing parts comprise a pin and a recess for the movable bearing support of the jewelry element, wherein the pin converges in the direction of the recess according to a defined converging angle and the recess diverges in direction of the pin according to a diverging angle, in that the diverging angle is greater than the converging angle, and in that the pin and the recess meet at the vertex of the diverging angle and converging angle to form a point-type bearing support.

Based on the prior art, it was realized according to a second alternative that the bearing support can be optimized with regard to friction when a point-type bearing support is realized. In so doing, the pin and recess meet at the vertex of their converging angle and diverging angle. The larger diverging angle and the smaller converging angle provide for a bearing support which is free from friction losses in the absence of contact surfaces. The arrangement is free of lubricant; only normal cleaning is occasionally necessary. Further, a defined rotation of the jewelry element is possible with this point-type bearing support. The full 360-degree revolution of the jewelry element optimizes appreciation of the jewelry element by enlarging the perceived image. Then, because of the inertia of the eye, the jewelry element can be perceived in the manner of a body of rotation. Due to the rotation and the refraction of light, a polished stone is perceived visually as a completely novel creation in and of space.

Further, the above-stated object is met in part by an embodiment. Accordingly, a bearing device for forming an arrangement for the presentation of a jewelry element, wherein the bearing device and the jewelry element each have a pair of bearing parts for supporting the jewelry element, is constructed in such a way that the bearing device has two free ends facing one another at a distance, in that a bearing part is arranged at each free end, in that the bearing device is preferably formed in one piece, in that each bearing part of the bearing device can be connected to the bearing part of the jewelry element which extends between the free ends of the bearing device in the mounted state, and in that the bearing device can be connected to a carrier.

Based on the prior art, a simplification of the bearing support in terms of design was desirable. This simplification is carried out, according to the invention, by providing a one-part bearing device which already integrates two bearing parts for supporting the jewelry element and which, through its shaping with two bearing parts facing one another, can determine a defined axis, which is advantageous precisely with respect to a movable, rotatable bearing support of the jewelry element. Accordingly, no soldering and/or severing need be carried out on the carrier itself, and the complicated, axially precise orientation of opposite bearing elements is dispensed with. The bearing device advantageously has bearing parts which are oriented to and cooperate with the bearing parts of the jewelry element and which have a given spacing that is adapted to the jewelry element. This does away with the expense of additional tools and additional time. The bearing device according to the invention can be associated with any carriers, for example, also with respect to a unit that can be retrofitted. The preferred bearing device with a curved portion and two bearing parts facing one another at the free ends requires less material for the same stability, which is a positive factor in terms of cost particularly when using precious metal. When the bearing parts of the bearing device are formed as pins, the one-piece bearing device can be formed of a single material and there need not be any differences in material between the pin and the connection portion as would be the case in the setting which should be made of a material that is softer than the material of the pin because of its contact with the precious stone. Therefore, the bearing parts of the bearing device are preferably formed as pins.

The use of a bearing device simplifies positioning in the carrier and permits large-scale manufacture and a modular assembly adapted to the carrier and the jewelry element. Further, with movable support of the jewelry element, the axis of rotation formed between the point-type bearings runs directly at the outer surface of the carrier without impairing stability. The bearing device can be arranged at the carrier in any manner desired and the axis of rotation can extend parallel to, perpendicular to, or at an angle to a horizontal substrate. Another advantage of the bearing device is a rapid, economical exchangeability in case repairs are required.

Various aesthetic effects of the jewelry element arrangement can be achieved by means of the bearing device in that the bearing parts and pins facing one another always form an alignment or imaginary axis of rotation with respect to the tips of the pins, but the tips of the pins lie outside the center line of the bearing device. The imaginary axis of rotation between the point-type bearings can, but need not, coincide with the center line of the bearing device.

Finally, the above-stated object is met through an embodiment, wherein a method of the type mentioned above is provided in such a way that the bearing device is introduced into a receptacle of a carrier, wherein the bearing device is initially captively and loosely connected to a jewelry element by opposite bearing parts, wherein a deformation of the bearing device takes place when the bearing device is inserted into the receptacle such that bearing parts of the bearing device and bearing parts of the jewelry element are moved toward one another and the jewelry element is supported fixedly or movably depending on the design of the bearing parts.

The assembly method according to the invention makes it possible to reduce production costs by using a bearing device which already has pre-adjusted bearing parts and which is made to engage with the bearing parts of the jewelry element during assembly through deformation of the bearing device. Accordingly, two steps are carried out by one process—the fixing of the bearing device in the carrier and the definitive fastening of the jewelry element between bearing parts of the bearing device which are moved toward one another during assembly.

The modular structural component parts—the carrier, the bearing device and the jewelry element—could advantageously be manufactured in series. This would further minimize production costs. In so doing, the carrier, the bearing device and the jewelry element could have determined, graduated dimensions which are adapted to one another. A system could be formed from the modular structural component parts having a functional relationship to one another. This simplifies the work of the jeweler or designer and marketing personnel. It should be noted in this connection that the jewelry element can not only be a precious stone with a setting, but can also be an ornament of inexpensive material so that the arrangement according to the invention could be used not only for jewelry but also in the advertising field or even in the field of optics as an ornament for eyeglasses.

Mounting could be further facilitated in that the bearing device and the jewelry element are pre-assembled and further processed as such. In this regard, the bearing parts could be loosely but captively connected in the pre-assembled state, while the actual connection could first be made when mounted in the carrier.

As is already known from the prior art, the carrier could itself be an object of jewelry, for example, a ring, pendant or brooch. A carrier could also possibly have the form of a clock or decoration. Alternatively or in addition, the carrier could also be allocated to an object. One possibility, for example, would be a wooden ring or a ring of semiprecious stone in which the carrier is integrated. In terms of material, objects of glass, crystal, plastic or stone could be considered and could also be used for decorative purposes, e.g., as paperweights. With regard to connecting to an object, all three of the modular structural component parts could also be pre-mounted.

The arrangement according to the invention could be carried out particularly effectively in that the jewelry element is supported in the bearing device so as to be movable, preferably rotatable, and/or, further, in that the bearing device is also mounted at the carrier so as to be movable, preferably rotatable. The bearing device could also be constructed itself as a jewelry element and, for example, outfitted with brilliant-cut diamonds. The bearing device can have any desired shape, including a stirrup shape, a ring shape in which opposite bearing parts are arranged for the jewelry element and for the carrier.

In another construction of the arrangement according to the invention, the jewelry element and/or the bearing device can carry out at least one full revolution of 360° around an imaginary axis between the bearing parts of the jewelry element and of the carrier or of the bearing device anchored in the latter or between the bearing parts of the bearing device and of the carrier. The 360-degree rotation produces the visually enhanced impression of a rotationally symmetric body.

In addition, when the jewelry element or possibly the bearing device, is supported in a movable manner, permanent magnets could be provided for influencing the movement and the stopping of the jewelry element and, as the case may be, of the bearing device.

As regards the second alternative of the arrangement relating to the bearing support of the jewelry element in a point-type bearing support, specifically at the vertex of the diverging angle and converging angle of the bearing parts in the form of a pin and a recess tapering to a point, it is particularly preferable for purposes of achieving a substantially frictionless and stable point-type bearing support when the diverging angle is approximately 90° and the converging angle is approximately 60°. The risk of friction increases when the converging angle substantially exceeds 60° and the diverging angle falls substantially below 90°. There is a risk of breakage when the diverging angle substantially exceeds 90° and the converging angle falls substantially below 60°.

When the jewelry element comprises a precious stone with a setting, the setting should be made of a soft material such as gold, for example. On the other hand, bearing parts in the form of pins by means of which the rotational movement is realized should be made of a harder material such as steel, for example. Therefore, it is advisable to allocate the recesses to the jewelry element or to the setting of the precious stone and to allocate the pin to the carrier or—according to a preferred embodiment example—to a separate bearing device that can be associated with the carrier. With respect to material, other substances are also possible; apart from precious or nonprecious metals, plastics of varying degrees of hardness are also a possibility.

A positively engaging connection and/or frictionally engaging connection and/or material bond could be formed between this bearing device and the carrier. According to a proven embodiment example, the carrier could have a receptacle for the bearing device, in particular a groove could be cut into the carrier. The groove and the bearing device could be adapted to one another with respect to shape. Accordingly, the receptacle could have the shape of a curved groove, while the bearing device could have a curved shape with two free ends at which the bearing parts are arranged at a distance from one another and facing one another. The curve could be circular, polygonal, or have some other shape.

In order to realize a fast and therefore economical assembly, the bearing device could form a curve whose radius is slighter greater in the unassembled state than the radius of the groove that also forms a curve. The reason behind this is that when the bearing device is inserted into the groove a deformation of the bearing device takes place, wherein the bearing parts of the free ends are moved toward one another, project farther into the bearing parts of the jewelry element, and form the point-type bearing support at the vertex of the receptacle. During its deformation, the bearing device adapts to the shape of the groove. This can be a plastic deformation or an elastic deformation. Of special importance is the fact that the assembly or mounting according to the invention results in a self-alignment which greatly simplifies the effort of mounting the jewelry element.

The bearing parts of the bearing device could have a defined initial distance from the bearing parts of the jewelry element so that the assembly mentioned above leads to the desired result of forming the point-type bearing support. In the course of mounting or upon completion of mounting, the radii of the groove and bearing device could be almost identical, and the initial distance between the bearing parts of the bearing device and the bearing parts of the jewelry element is reduced to zero by the deformation of the bearing device. According to an embodiment example, the jewelry element could have a diameter of approximately 6 mm and cooperate with a bearing device that can fit into a groove of the carrier taking into account the initial distance between the bearing parts and the deformation. The groove is produced by a milling cutter having a diameter of about 7.5 mm. Accordingly, adapting to the initial spacing, the radius of the bearing device would have to be slightly greater than 3.25 mm. According to another embodiment example, the jewelry element could have a diameter of approximately 9 mm which requires a curved bearing device fitting into a groove that is produced by a milling cutter having a diameter of approximately 11 mm. Accordingly, adapting to the initial spacing, the radius of the bearing device would have to be slightly greater than 5.5 mm. When the jewelry element is based, for example, on a round brilliant-cut diamond with a round setting, only five graduated setting sizes of between 0.1 ct and 1.25 ct would be required for the brilliant-cut diamonds which deviate from one another by 0.1 ct. The dimensions of the bearing device and carrier are graduated in a corresponding manner. This also illustrates the idea of the modular construction in the first alternative of the arrangement according to the invention which is reflected here in the embodiment examples of the second alternative.

When the mounting has been concluded, the bearing parts of the carrier or of the bearing device and of the jewelry element could be arranged on an imaginary axis around which the jewelry element is rotatable. The points of the point-type bearing define the axis of rotation. The bearing parts themselves need not extend around the axis of rotation in a rotationally symmetric manner, but rather may deviate from the latter. This is relevant with regard to facilitating assembly because a bearing part, particularly the pin, can also be bent slightly. Besides inserting the bearing device into the receptacle of the carrier, additional steps such as soldering, riveting, lasing, screwing, and gluing can also be carried out. This depends on the desired fastening technique which ranges from exactly fitting positively engaging and frictionally engaging connections, e.g., a clamping connection, to material bonding. Leftover materials serving to embed the bearing device could be provided at the carrier beforehand and could be liquefied and close the groove-shaped receptacle with the bearing device fitted therein.

As regards the construction of the bearing device according to the invention and the mounting method according to the invention, reference is had to the description of the two alternatives of the arrangement according to the invention.

Additional advantages of the two variants of the arrangement according to the invention, the bearing device according to the invention and the mounting method according to the invention also result with respect to an optimized design of the carrier which, for example, can be in the form of a ring. It is not necessary to provide any reinforced areas at the carrier having threads or other bearing parts as in the known prior art. The invention facilitates the visual effect of the jewel. The jewelry element can be integrated in the carrier in an optimal manner and is not visually separated from the carrier by protruding parts. Compact pieces of jewelry are made possible by the bearing device inside the carrier. Time is saved in that the point-type bearing support is formed automatically when the bearing device is mounted in the carrier.

There are various possibilities for arranging and developing the teaching of the present invention in an advantageous manner. In this respect, reference is had to the claims following claim 1 and to the following description of a plurality of embodiment examples of the invention referring to the drawings. Preferred arrangements and further developments of the teaching are also described generally in connection with embodiment examples of the invention.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

FIGS. 1 to 5 show an arrangement for the presentation of a jewelry element 2 with a carrier 1 on which the jewelry element 2 is mounted. The carrier 1 and the jewelry element 2 each have a pair of bearing parts 3, 4, 5, 6 for the bearing support of the jewelry element 2.

According to a first alternative of the invention, the bearing parts 3, 6 which are allocated to the carrier 1 form a structural component part of a separate bearing device 7. The carrier 1, the jewelry element 2 and the bearing device 7 are modular structural component parts and the one-piece bearing device 7 can be connected to the carrier 1 and to the jewelry element 2. The carrier 1, the bearing device 7 and the jewelry element 2 are manufactured in series and have dimensions which are adapted to one another.

Figure 1:
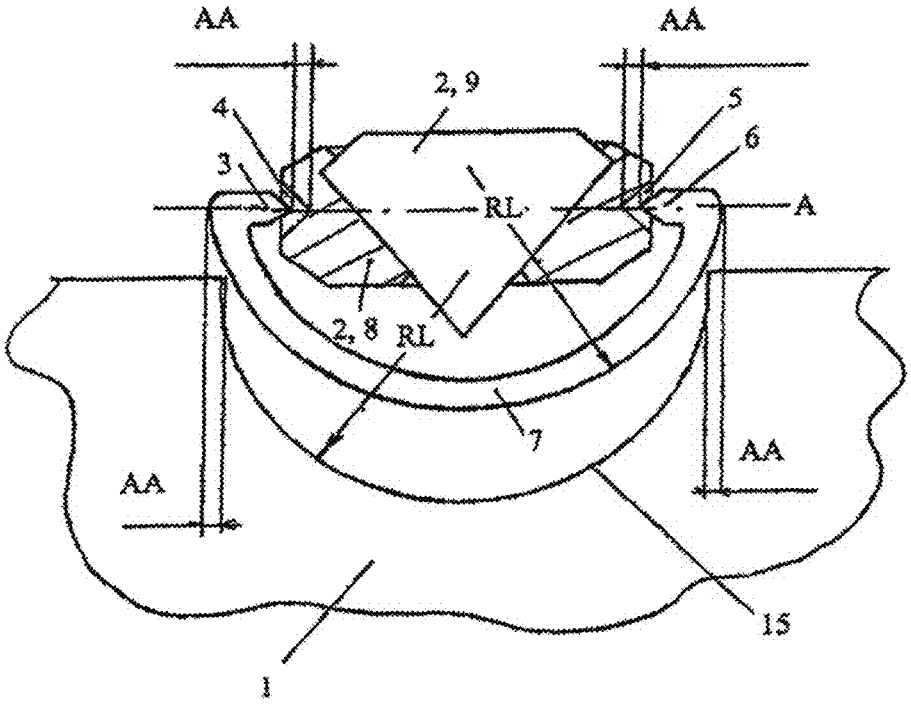
FIG. 1 is a schematic view in partial section showing a first embodiment example of an arrangement according to the invention.

FIG. 1 shows schematically that the bearing device 7 and the jewelry element 2 are pre-assembled. The bearing parts 3, 4, 5, 6 are connected loosely and captively in the pre-assembled state and the actual connection is not made until mounting in the carrier 1. The jewelry element 2 comprises a setting 8 and a precious stone 9 in all of the embodiment examples. The setting 8 contains the bearing parts 4, 5.

Figure 3:
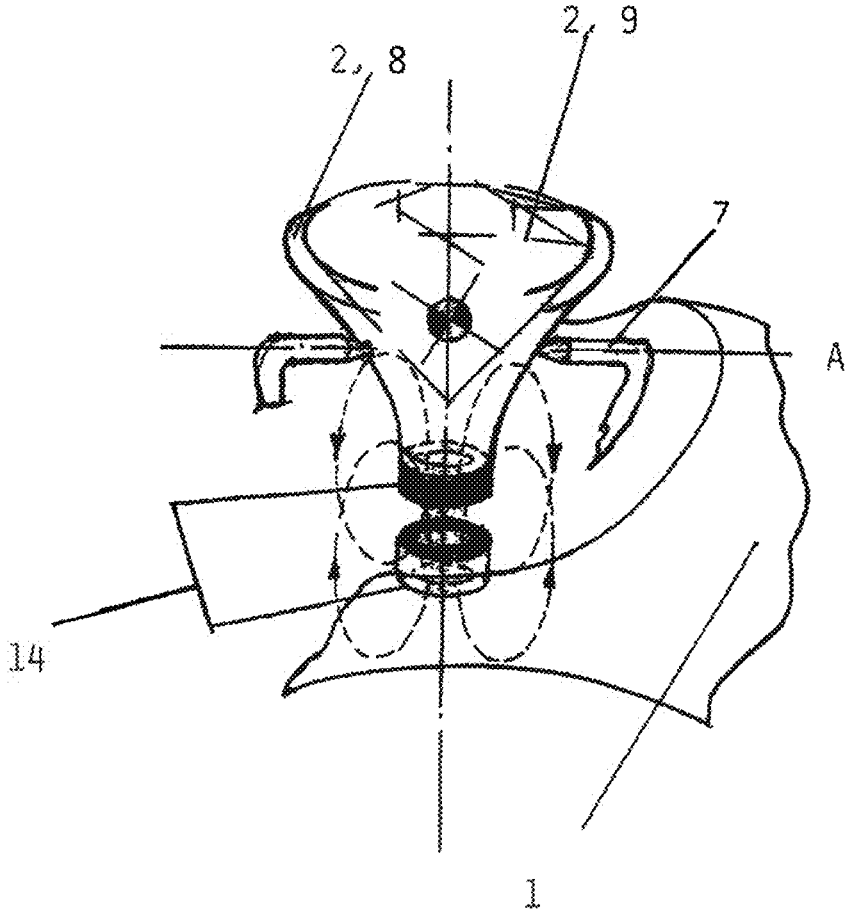
FIG. 3 shows a schematic view of a third embodiment example of an arrangement according to the invention.
Figure 4:
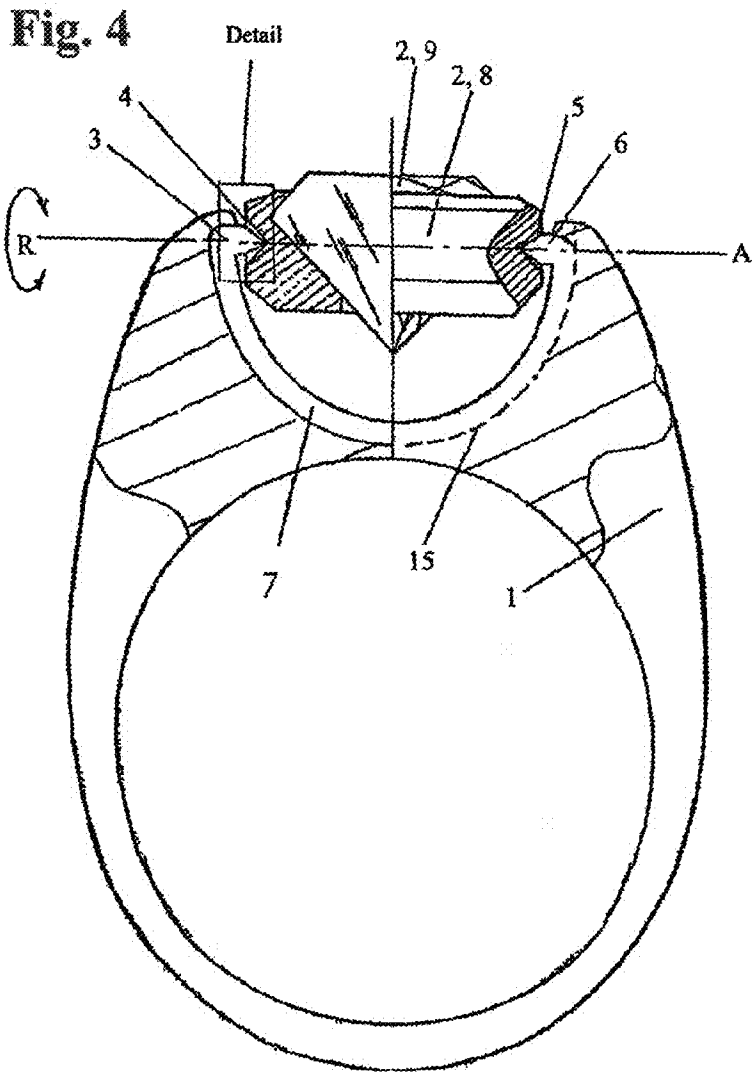
FIG. 4 is a schematic view in partial section showing a fourth embodiment example of the arrangement according to the invention.

FIGS. 3 and 4 show that the carrier 1 itself is an ornamental object in the form of a ring.

Figure 2:
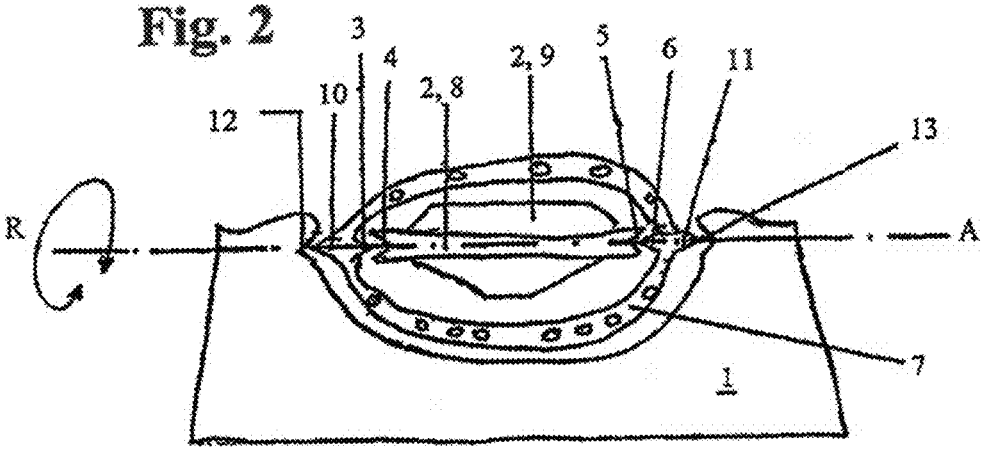
FIG. 2 shows a schematic view of a second embodiment example of the arrangement according to the invention.

In FIG. 2, the carrier 1 is provided after assembly with the bearing device 7 and the jewelry element 2 for inserting into another piece of jewelry, specifically a wooden ring. In this embodiment example, the bearing device 7 itself is an ornamental object and is outfitted with jewelry elements which are not referenced in further detail.

In all of the embodiment examples of the arrangement according to the invention, the jewelry element 2 is movably supported at the carrier 1 and at the bearing device 7. The jewelry element 2 can execute complete revolutions around an imaginary axis A between the bearing parts 4, 5 of the jewelry element 2 and the bearing parts 3, 6 of the bearing device 7 anchored in the carrier 1 in different orientations corresponding to arrow R resulting in the visually enhanced impression of a rotationally symmetric body.

Further, in the second embodiment example shown in FIG. 2, the bearing device 7 can also be constructed around an imaginary axis A between the bearing parts 10, 11 of the bearing device 7 and the bearing parts 12, 13 of the carrier 1, resulting in the visually enhanced impression of a rotationally symmetric body. In this case, the imaginary axis A is aligned with all of the bearing parts 3 to 6 and 10 to 13.

In the third embodiment example shown in FIG. 3, permanent magnets 14 are used to realize the movement and the stopping of the jewelry element 2 and possibly of the bearing device 7. The magnetic fields are indicated by arrows.

Figure 5:
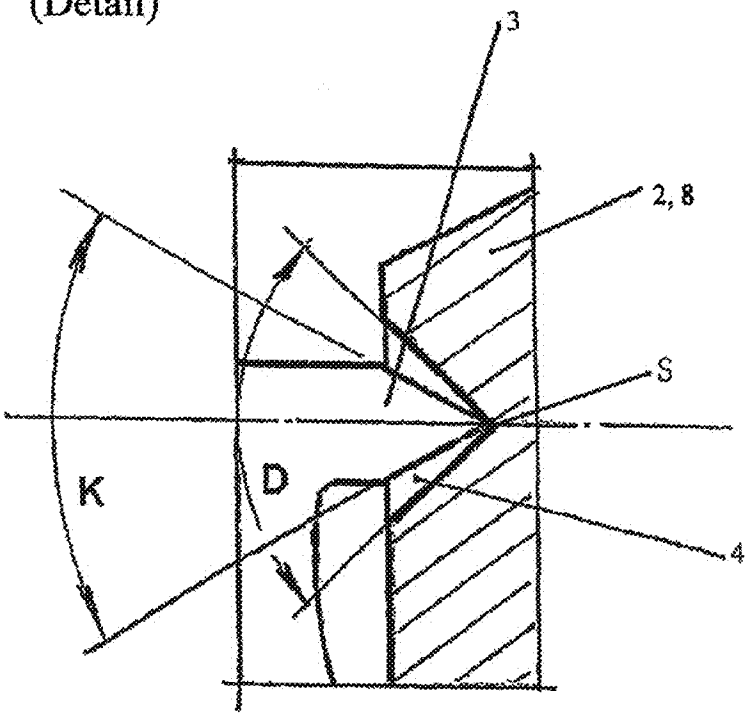
FIG. 5 is a schematic enlarged view of a detail from FIG. 4.

The second alternative of the arrangement according to the invention is illustrated more clearly by a fourth-embodiment example in FIG. 4 and FIG. 5. As in all of the other embodiment examples, the bearing parts 3, 4, 5, 6 each comprise a pin 3, 6 and a recess 4, 5 for the movable support of the jewelry element 2. The pins 3, 6 converge in direction of the recesses 4, 5 according to a defined converging angle K. The recesses 4, 5 diverge in direction of the pins 3, 6 according to a diverging angle D. The diverging angle D is greater than the converging angle K, and the pins 3, 6 and the recesses 4, 5 meet at the vertex of the diverging angle D and converging angle K to form a virtually frictionless point-type bearing support. In the fourth embodiment example according to FIG. 5, the diverging angle D is approximately 90° and the converging angle K is approximately 20°. In the first embodiment example according to FIG. 1, the diverging angle D is approximately 90° and the converging angle K is approximately 60°.

According to FIG. 4, the separate bearing device 7 which can be allocated to the carrier 1 and which is present in all of the embodiment examples is inserted into a receptacle 15 of the carrier 1 in the form of a curved groove. The bearing device 7 itself has a curved shape with two free ends at which the pin-shaped bearing parts 3, 6 are arranged at a distance from one another and facing one another.

The bearing device 7 forms a curve whose radius RL, as shown in FIG. 1 before mounting, is slightly greater than the radius RN of the groove-shaped receptacle 15 of the carrier 1 which likewise forms a curve. The bearing parts 3, 6 of the bearing device 7 have a defined initial distance AA from the bearing parts 4, 5 of the jewelry element 2. The same distance, designated by AA', also exists between the carrier 1 and the bearing device 7 so that the desired path of the bearing parts and pins 3, 6, respectively, to the bearing parts and recesses 4, 5 is covered and the point-type bearings are formed. The radii RL and RN are virtually identical in the mounted state shown in FIG. 4, wherein the initial distance AA between the bearing parts 3, 6 of the bearing device and the bearing parts 4, 5 of the jewelry element 2 is reduced to zero by the deformation of the bearing device 7.

Reference is had to the general description regarding other features not shown in the drawings.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. An arrangement comprising:

a jewelry element;

a carrier; and a bearing device;

wherein the bearing device is connected to both the carrier and the jewelry element in A mounted state;

wherein the bearing device has two bearing parts, each in the form of a pin;

wherein the jewelry element has two bearing parts, each in the form of a recess;

wherein the pins and recesses are for mounting the jewelry element, with the pins and recesses being spaced apart from each other, respectively, so that each pin faces a respective recess;

wherein the bearing device has a stirrup shape with two free ends, on which the pins are arranged;

wherein the carrier has a receiver in the form of a curved groove for the bearing device;

wherein each pin converges in a direction of the corresponding recess in accordance with a defined converging angle;

wherein each recess diverges in a direction of the corresponding pin in accordance with a diverging angle;

wherein the diverging angle is greater than the converging angle; and wherein each pin and corresponding recess meet one another at a vertex of the diverging and converging angles, so as to form a spot-type mounting.

2. The arrangement according to claim 1;

wherein the carrier, the bearing device, and the jewelry element are manufactured as separate modules to be assembled together at a later time.

3. The arrangement according to claim 1;

wherein the carrier, the bearing device, and the jewelry element are supplied in determined graduated dimensions which are adapted to one another.

4. The arrangement according to claim 1;

wherein the bearing device and the jewelry element are pre-assembled; and wherein the bearing parts are loosely and captively connected in the pre-assembled state before mounting in the carrier.

5. The arrangement according to claim 1;

wherein the carrier itself is an ornamental object.

6. The arrangement according to claim 1;

wherein the bearing device and the jewelry element and the carrier are pre-assembled.

7. The arrangement according to claim 1;

wherein the jewelry element is movably supported at the carrier or at the bearing device.

8. The arrangement according to claim 1;

wherein the bearing device is configured to be movably supported at the carder and is itself an ornamental object.

9. The arrangement according to claim 1;

wherein the jewelry element or the bearing device or both are configured to carry out at least one fall revolution of 360° around an imaginary axis (1) between the bearing parts of the jewelry element and the bearing parts of the carrier or of the bearing device anchored in the carrier, or (2) between the bearing parts of the bearing device and bearing parts of the carrier, resulting in the visually enhanced impression of a rotationally symmetric body.

10. The arrangement according to claim 1;

wherein moving and stopping of the jewelry element is carried out by permanent magnets.

11. An arrangement comprising:

a jewelry element; and a carrier;

wherein the carrier and the jewelry element each have a pair of bearing parts for supporting the jewelry element;

wherein the bearing parts comprise a pin and a recess for movably supporting the jewelry element;

wherein the pin converges in the direction of the recess according to a defined converging angle;

wherein the recess diverges in direction of the pin according to a diverging angle which is greater than the converging angle; and wherein the pin and the recess meet at the vertex of the diverging angle and the vertex of the converging angle to form a point-type bearing support;

wherein the two bearing parts of the carrier are component parts of a separate bearing device that is configured to be associated with the carrier;

wherein the bearing parts of the beating device have a defined initial distance from the bearing parts of the jewelry element in an unassembled state wherein a radius of a groove of the carrier and a radius of the bearing device are virtually identical in an assembled state; and wherein the initial distance between the bearing parts of the bearing device and the bearing parts of the jewelry element is reduced to zero by a deformation of the bearing device.

12. The arrangement according to claim 11;

wherein the diverging angle is approximately 90° and the converging angle is approximately 60°.

13. The arrangement according to claim 11;

wherein the bearing part in the form of the pin is made of a different material than the bearing part in the form of the recess.

14. The arrangement according to claim 11;

wherein at least one of a positively engaging connection, a frictionally engaging connection, and a material bond is configured to be formed between the bearing device and the carrier.

15. The arrangement according to claim 11;

wherein the bearing device has a curved shape with two free ends at which the bearing parts are arranged at a distance from one another and facing one another.

16. An arrangement comprising:

a jewelry element; and a carrier;

wherein the carrier and the jewelry element each have a pair of bearing parts for supporting the jewelry element;

wherein the bearing parts comprise a pin and a recess for movably supporting the jewelry element;

wherein the pin converges in the direction of the recess according to a defined converging angle;

wherein the recess diverges in direction of the pin according to a diverging angle which is greater than the converging angle;

wherein the pin and the recess meet at the vertex of the diverging angle and the vertex of the converging angle to form a point-type bearing support;

wherein the two bearing parts of the carrier are component parts of a separate bearing device that is configured to be associated with the carrier;

wherein the bearing device has a curved shape with two free ends at which the bearing parts are arranged at a distance from one another and facing one another; and wherein the bearing device forms a curve whose radius is slightly greater in an unassembled state than a radius of a groove of the carrier that also forms a curve.

17. The arrangement according to claim 11;

wherein the jewelry element has a diameter of approximately 6 mm and cooperates with the bearing device that is configured to fit into a groove of the carrier; and wherein the groove is produced by a tool, the tool having a diameter of about 7.5 mm.

18. The arrangement according to claim 11;

wherein the bearing parts of the carrier and the bearing parts of the jewelry element are arranged on an imaginary axis around which the jewelry element is rotatable by 360°.

19. A method for assembling an arrangement;
the arrangement comprising:
a jewelry element; and
a carrier;
wherein the carrier and the jewelry element each have a pair of bearing parts for supporting the jewelry element;
wherein the bearing parts associated with the carrier are a component part of a separate bearing device;
wherein the carrier, the jewelry element and the bearing device are modular structural component parts; and
wherein the bearing device is configured to be connected to the carrier and to the jewelry element;
the method comprising:
introducing the bearing device into a receptacle of the carrier; and
initially captively and loosely connecting the bearing device to the jewelry element by opposite bearing parts;
wherein a deformation of the bearing device takes place when the bearing device is inserted into the receptacle such that bearing parts of the bearing device and bearing parts of the jewelry element are moved toward one another and the jewelry element is supported fixedly or movably.

20. A method for assembling an arrangement;
the arrangement comprising:
a jewelry element; and
a carrier;
wherein the carrier and the jewelry element each have a pair of bearing parts for supporting the jewelry element;
wherein the bearing parts comprise a pin and a recess for movably supporting the jewelry element;
wherein the pin converges in the direction of the recess according to a defined converging angle;
wherein the recess diverges in direction of the pin according to a diverging angle which is greater than the converging angle; and
wherein the pin and the recess meet at the vertex of the diverging angle and the vertex converging angle to form a point-type bearing support;
the method comprising:
introducing the bearing device into a receptacle of the carrier; and
initially captively and loosely connecting the bearing device to the jewelry element by opposite bearing parts;
wherein a deformation of the bearing device takes place when the bearing device is inserted into the receptacle such that bearing parts of the bearing device and bearing parts of the jewelry element are moved toward one another and the jewelry element is supported fixedly or movably.

21. A method for assembling an arrangement;
the method comprising:
a bearing device; and
a jewelry element;
wherein the bearing device and the jewelry element each have a pair of bearing parts for supporting the jewelry element;
wherein the bearing device has two free ends facing one another at a distance;
wherein a bearing part is arranged at each free end of the bearing device;
wherein each bearing part of the bearing device is configured to be connected to a bearing part of the jewelry element which extends between the free ends of the bearing device in a mounted state; and
wherein the bearing device is configured to be connected to a carrier;
the arrangement comprising:
introducing the bearing device into a receptacle of the carrier; and
initially captively and loosely connecting the bearing device to the jewelry element by opposite bearing parts;
wherein a deformation of the bearing device takes place when the bearing device is inserted into the receptacle such that bearing parts of the bearing device and bearing parts of the jewelry element are moved toward one another and the jewelry element is supported fixedly or movably.

* * * * *